US006698253B2

(12) United States Patent
Stoll et al.

(10) Patent No.: US 6,698,253 B2
(45) Date of Patent: Mar. 2, 2004

(54) METHOD OF AND ARRANGEMENT FOR DESIGNING OF TUBULAR ROUND KNITTED ARTICLES PRODUCED OF A FLAT KNITTING MACHINE

(75) Inventors: Thomas Stoll, Reutlingen (DE); Juergen Hermann, Kirchentellinsfurt (DE); Horst Fries, Reutlingen (DE); Hermann Weiss, Reutlingen (DE); Michael Haug, Dettingen (DE); Gerhard Ertl, Graz (AT)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 10/264,227

(22) Filed: Oct. 2, 2002

(65) Prior Publication Data

US 2003/0066316 A1 Apr. 10, 2003

(30) Foreign Application Priority Data

Oct. 6, 2001 (EP) ..... 01123919

(51) Int. Cl.[7] ..... D04B 7/24; G06F 19/00

(52) U.S. Cl. ..... 66/232; 700/131

(58) Field of Search ..... 66/232, 237; 700/131, 700/132, 141, 97, 135

(56) References Cited

U.S. PATENT DOCUMENTS

| | | | | | |
|---|---|---|---|---|---|
| 4,608,642 | A | * | 8/1986 | Shima | 700/141 |
| 4,856,104 | A | * | 8/1989 | Stoll et al. | 700/141 |
| 5,388,050 | A | * | 2/1995 | Inoue et al. | 700/131 |
| 5,557,527 | A | * | 9/1996 | Kotaki et al. | 700/131 |
| 5,719,777 | A | * | 2/1998 | Kotaki | 700/131 |
| 5,754,431 | A | * | 5/1998 | Kotaki | 700/97 |
| 6,611,730 | B1 | * | 8/2003 | Stoll et al. | 700/131 |

FOREIGN PATENT DOCUMENTS

EP 0 763 615 B1 6/2000

* cited by examiner

*Primary Examiner*—Danny Worrell
(74) *Attorney, Agent, or Firm*—Michael J. Striker

(57) ABSTRACT

A method of and an arrangement for designing tubular round knitted products on a flat knitting machine operates with the fine automation degree and a plurality of representing, designing and correcting possibilities.

18 Claims, 10 Drawing Sheets

METHOD OF AND ARRANGEMENT FOR DESIGNING OF TUBULAR ROUND KNITTED ARTICLES PRODUCED OF A FLAT KNITTING MACHINE

BACKGROUND OF THE INVENTION

The present invention relates to a method of and an arrangement for designing of tubular round knitted articles produced on a flat knitting machine.

Due to constantly increasing personal costs, a trend for producing knitted articles for which after the production of the knitting machine no additional fabrication works are needed has been observed. These knitted articles are usually tubular round final products which are produced with the use of the possibilities of modern electronically controlled, fully automatic flat knitting machines. The sleeve and body trunk parts of such a tubular round final article are first formed as separate tubular round knitted articles, before the sleeves must be connected to the body trunk part. Starting from this position, three individual tubular round knitted articles are knitted further as a single tubular round knitted article. Then shoulder shapes, neck portions and in some cases collars are knitted to them. The knitted article is therefore completely formed by the flat knitting machine. After this no seams must be closed any longer, and as a rule only the initial and the end thread portions are cleaned manually.

In the tubular round final articles which are formed of several parts, in order to produce very complex knitted articles correspondingly large numbers of knitting data for controlling the flat knitting machine must be provided. This no longer can be done manually. The European patent document EP 0 763 615 B1 discloses a device and a method for designing a round knitted article for a flat knitting machine, in which first a pattern for the knitted article is placed. Subsequently, a contour of the knitted article is selected by selection of contour shapes stored on the device and dimensional data for the front and rear parts as well as the sleeves are provided. After this manually for each individual contour region a knitting process description is produced, which depends on the pattern structures available in the corresponding contour region. Then, based on the knitting process description, the device automatically generates the control data for the flat knitting machine.

This known method makes possible a high automation degree during designing of tubular round final knitted articles. However, it has some disadvantages. The knitted articles can not have any arbitrary contours, but they can have only those contours which are contained in the selection stored in the device. Since the knitting process descriptions depend on the contour and the pattern in the corresponding contour region, it is necessary for each pattern structure occurring inside the contour to provide its own knitting process description, which is very expensive. Manual changes which are performed after the manufacture of the design are not transferred automatically to the original pattern representation, so that no visual control of the performed changes is possible. Furthermore, with the known method after the manufacture of the total design a close to reality representation of the knitting device can be visualized, but not the intermediate stages of designing, for example during the pattern association to a sleeve or the like.

SUMMARY OF THE INVENTION

Accordingly, it is an object of the present invention to provide method of and device for designing tubular round knitted articles produced on a flat knitting machine, which avoid the disadvantages of the prior art.

More particularly, it is an object of the present invention to provide a method of and device for designing a tubular round knitted articles, which are user-friendlier than the known solutions and allow a higher automation degree.

In keeping with these objects and with others which will become apparent hereinafter, one feature of the present invention resides, briefly stated, in a method of designing of tubular round knitted articles on a flat knitting machine with at least one front part and at least one rear part, which comprises the following steps:

- preparation of a knitting pattern for each front part and each rear part as well as in some cases further knitted parts such as pockets, independently from the shape of the knitted piece by means of an inputting and indicating device and storing the pattern data,
- describing the contour of each front part and each rear part by means of the inputting and indicating device and storing the contour data,
- fixing the contour portion of the knitted parts on which a connection with another knitted part must be produced, and storing the data of this contour portion,
- assembling the contours of the knitted parts to a total knitted piece and determining a sequence of knitting rows, with which the total knitted piece is producible,
- for each knitted part indicating the knitting pattern and the contour on the indicating device, by means of the inputting device displacing the contour onto the knitting pattern until the knitting pattern fills the contour in a desired manner,
- indicating the total knitted piece with the selected and stored knitting pattern-and contour data for the individual knitted part,
- determining the knitting information for each knitting row for providing the total knitting piece in accordance with the pattern and contour data of the knitting parts.

The knitting information for each knitting row can be converted into knitting data for a flat knitting machine and thereby one or several flat knitting machines can be controlled for producing the tubular round knitting article.

With the inventive method only a few steps can be performed manually. They are limited to the perforation of a knitting pattern for each knitted part, the fixing of the contours of the knitted part as well as the connection portion of the individual knitted parts, and the introduction of the knitting pattern into the contour of the corresponding knitted part. When these data are provided, then automatically the required sequence of knitting rows is generated for production of the total knitting piece as well as the knitting information for each individual knitting row. Correction possibilities both of the pattern and the contour are possible in each designing stage. During a correction of the pattern or the contour of the total knitted piece, moreover the made changes can be provided automatically in the stored pattern and the contour data of the corresponding individual knitted part. Also, after a correction, the individual representations of the knitted parts and the representation of the total knitted piece coincide with one another.

The knitted patterns can be designed preferably in the loop formation representation or in the thread running representation. From the data for one individual representation type the data for another representation type can be calculated, so that the knitted pattern in each design stage of the knitted article is indicatable in both representation types. Further advantages are provided when in the case of the loop formation representation a reality-close approximately three-dimensional representation of all elements of the knitted piece, such as loops, tucks and floating is provided.

A tubular round knitted article is composed of at least three knitting plates, one for the front part and one for the rear part. With pocket-and/or special patterning, further knitting planes can be produced. In accordance with a preferable variant of the inventive method, the individual knitted parts are associated with one or several planes of the total knitted piece. It is advantageous when also each knitting element, such as loops, tucks, floatings of one knitted part are associated with one of the knitting planes. Thereby for the user it is clear, in which plane the corresponding knitting elements are formed.

For facilitating the designing of the knitting pattern for the knitted parts, portions from a knitting pattern can be stored as individual modules, which at different locations of the pattern or during designing of the knitting patterns of another knitted parts can be again utilized. A significant facilitation of this modular technique is moreover also possible when the modules with the new use at other locations can be joined with a loop technique correctly in the surrounding knitting pattern, and if necessary, an adaptation of the knitting article plane association to the individual knitting elements of the module can be performed.

The fixing of the contour portions of the knitted parts, on which a connection with another knitted part might be produced, can be performed so that the starting and end points of the portion and the type of the connection are determined for example with or without performing a longitudinal compensation between the knitted parts and can be stored.

The invention also deals with an arrangement for designing tubular round knitted articles produced on a flat knitting machine with at least one front part and at least one rear part, that has at least one storage device for the designing data, at least one indicating device for representation of design formations of the knitted article and at least one inputting device for producing and changing the design former, wherein in accordance with the present invention it has at least one device for assembling the contours of the at least one front part and the at least one rear part in accordance with a manually inputtable connection steps and for calculating the knitted rows required for production of the contour of the total knitted piece, as well as for calculating the knitting information for each knitting row of the total knitted article in accordance with the pattern-and contour data of the individual knitted parts.

The arrangement also has a device for converting the knitting information of each knitting row into a knitting data for a flat knitting machine. In accordance with a preferable embodiment, the indicating device can be formed so that simultaneously loop formation and thread running representations of the knitted article or the knitted article parts are reproducible.

Further decisive advantages, in particular during correction of the knitted product production, are produced when the arrangement during change of one or the both representation types simultaneously changes the other representation.

For facilitating the knitting pattern production, the arrangement can be provided with devices for combining several knitting elements of a thread running-or loop formation representation to modules and storing devices for storing the modules. Furthermore, the devices for loop-technically correct insertion of modules in an available knitting pattern, for reducing and increasing, for multiplying and for inverting of modules can be provided.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
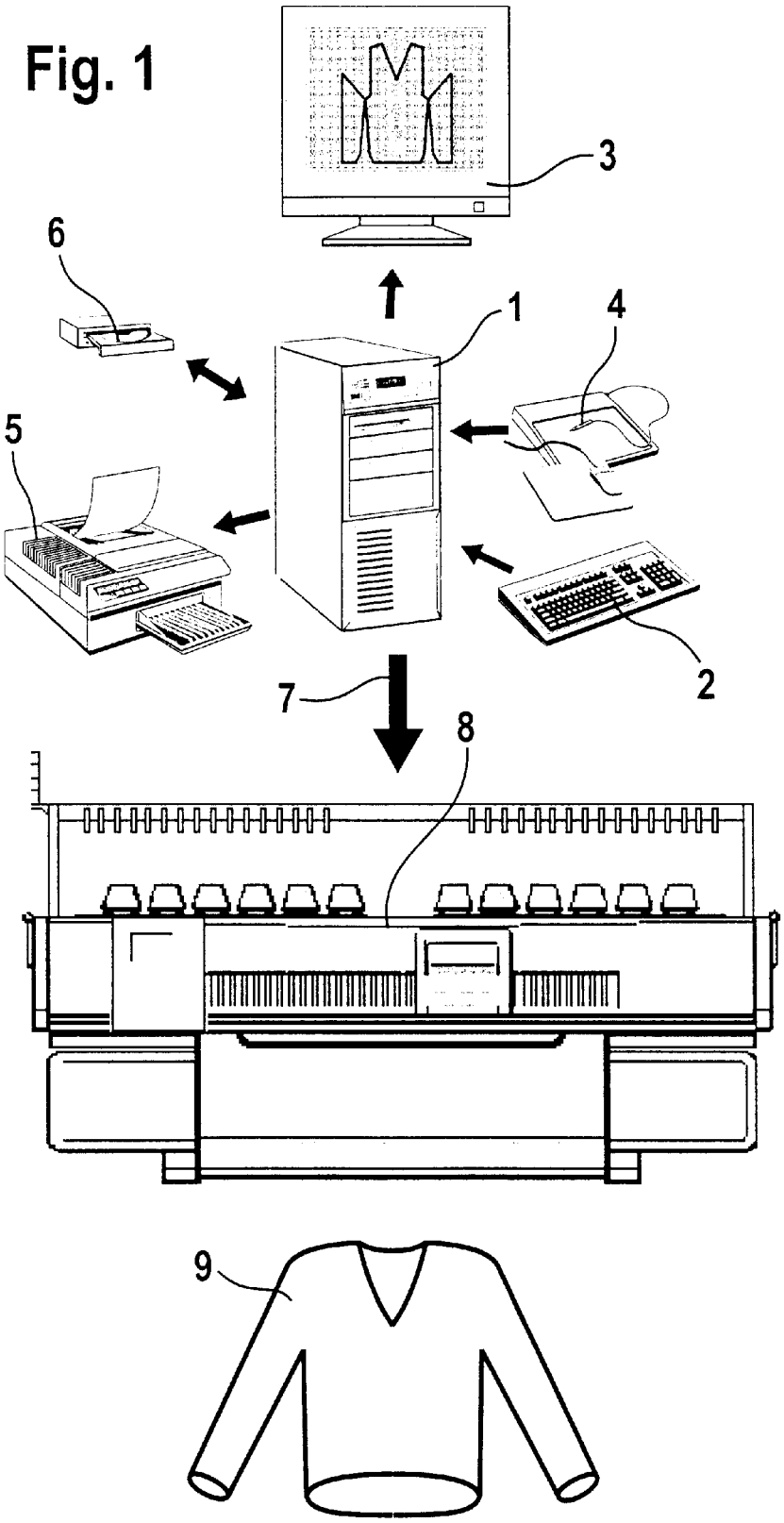
FIG. 1 is a principle view of an inventive designing arrangement together with a flat knitting machine and a tubular round final knitted article.

FIG. 1 shows a designing arrangement for producing a tubular round final knitted article 9 by means of a flat knitting machine 8. The designing arrangement has a computing and storage device 1, a keyboard 2 as a first inputting device, a graphic tablet 4 as a second inputting device, and an image screen 3 as an indicating device. A printer 5 and an external mass storage 6 are connected to the computing and storage device 1.

FIGS. 2–7 show various pattern representation-and design possibilities of an inventive method and an inventive arrangement.

Figure 2A:
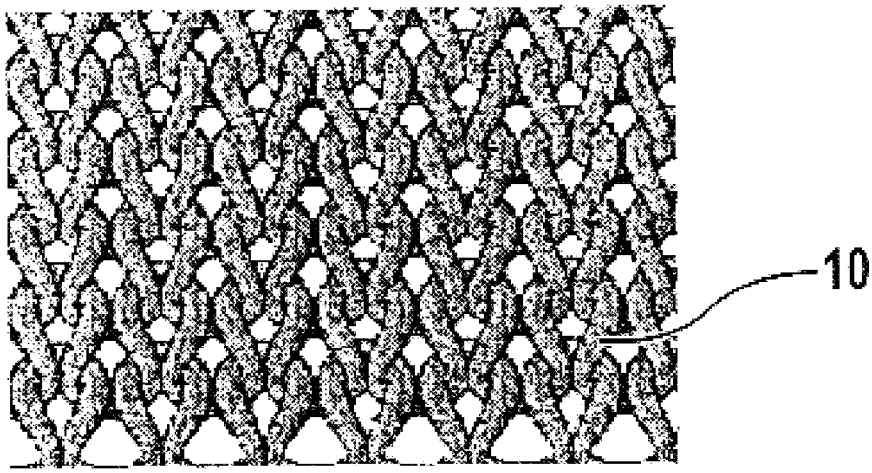
FIGS. 2*a* and 2*b* are views showing a partial view of a front side of a tubular round knitted article in stitch formation representation and a thread running representation correspondingly.
Figure 2B:
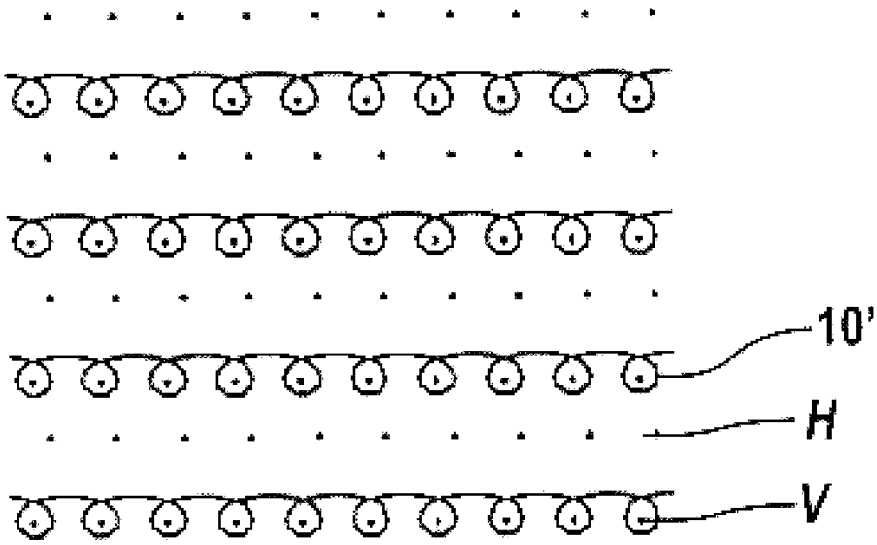

FIG. 2*a* shows a loop formation representation of a section of the outer view of a front side of a right smooth tubular round knitted article. The loops 10 of the front part are right loops, and in FIG. 2*a* are shown as in the final knitted article. FIG. 2*b* shows the thread running representation corresponding to FIG. 2*a* wherein the loops 10 here are formed on the front needle bed V.

Figure 3A:
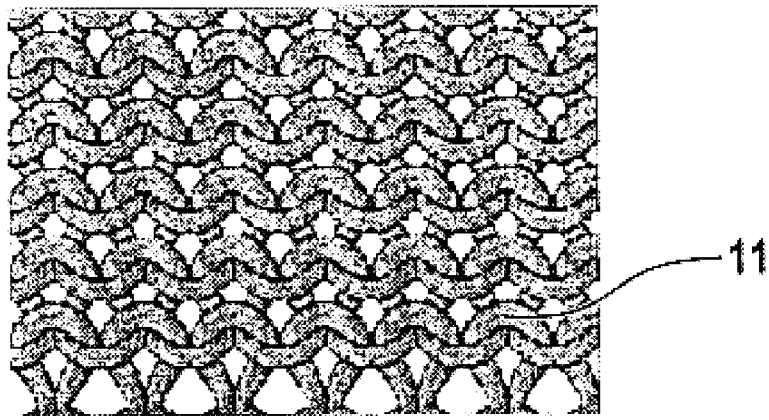
FIGS. 3*a*–3*c* are views showing two stitch formation representations and a thread running representation of a portion of a rear part of a tubular round knitted article.
Figure 3B:
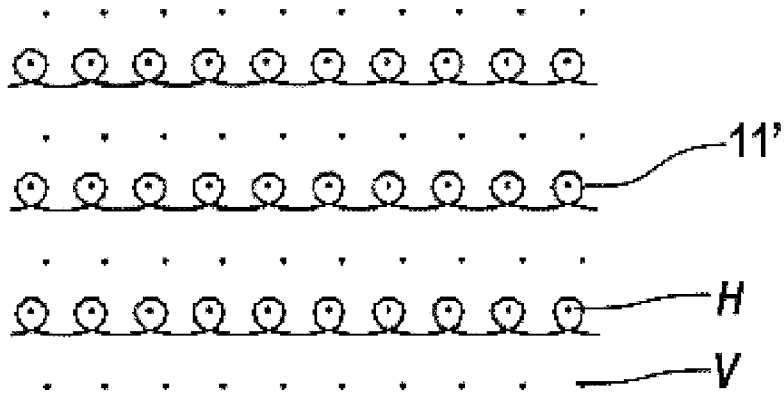
Figure 3C:
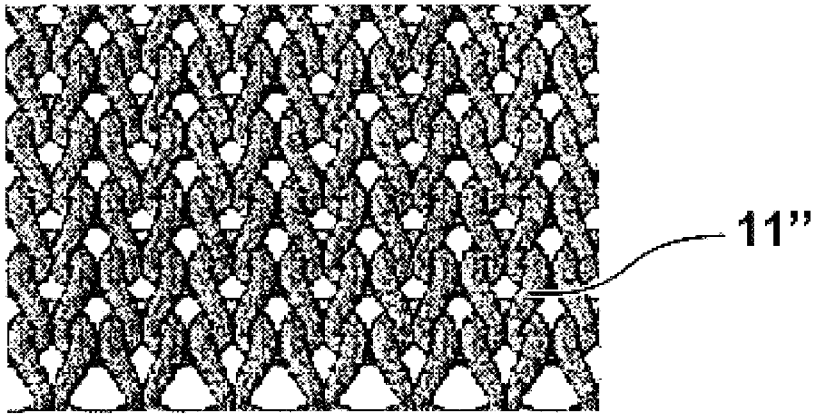

FIG. 3*a* shows the inner view of the rear part of a right smooth tubular round final knitted article. The loops 11 are left loops and formed, as in the thread running representation in FIG. 3*b*, on the rear needle bed H. FIG. 3 shows the outer view of the rear part of the tubular round knitted article. Here the loops 11 are shown as right loops.

Figure 4A:
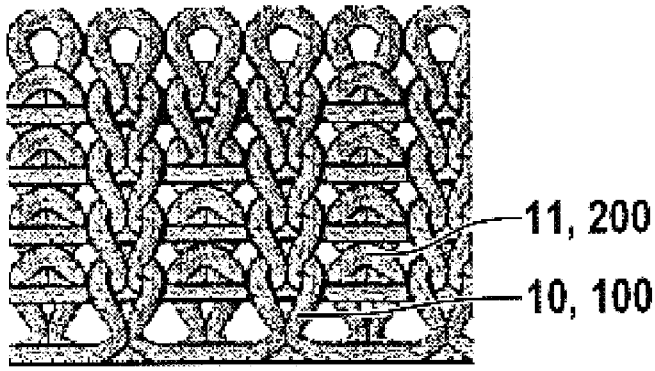
FIGS. 4*a* and 4*b* are views showing a joint representation of the front and the rear parts from FIGS. 2 and 3 in a loop formation representation and a thread running representation.
Figure 4B:
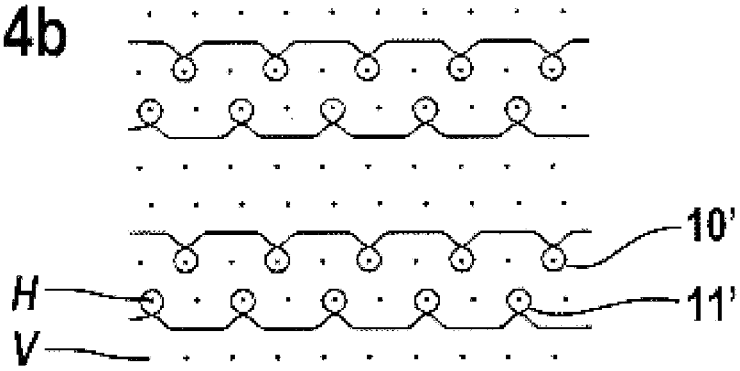

FIG. 4*a* shows in the general view the front-end rear part from FIGS. 2*a* and 3*a* as a loop formation representation in a combined view. The right loops 10 of the front part belong to the first plane 100 of the total knitted product and the loops 11 to the second plane 200. In this example a right smooth tubular round knitted article has only two knitting planes, the first knitting plane 100 for the front part and the second knitting plane 200 for the rear part. FIG. 2*b* shows the thread running representation corresponding to FIG. 4*a*. The loops 10 are formed on the front needle V and the loops 11 of the rear part are formed on the rear needle bed H.

Figure 5A:
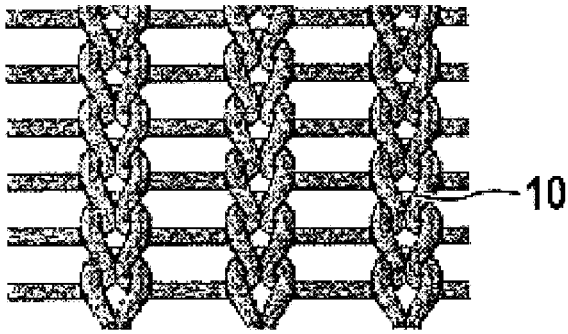
FIGS. 5*a* and 5*b* are views showing representation of the front part of FIG. 2 in a loop formation representation and a thread running representation, which clearly show the knitting production.
Figure 5B:
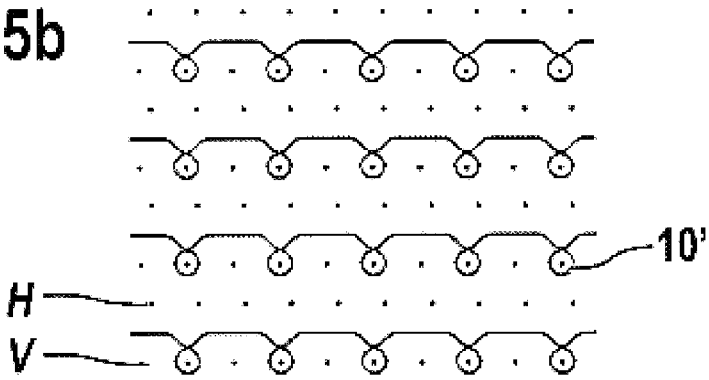

FIG. 5*a* shows a further type of the representation of the front part of FIG. 2*a* in the loop formation representation, wherein the loops 10 are shown as they actually are suspended in the needles of the front needle bed. FIG. 5*b* illustrates that the loops 10 are knitted only with each second needle of the front needle bed V. It can be seen that the loops 10 in FIG. 5*a* are pulled further from one another than the loops 10 in the representation of FIG. 2*a*, which is a reality-closed representation of the front part and does not consider the knitting-technical production of the knitted article.

Figure 6A:
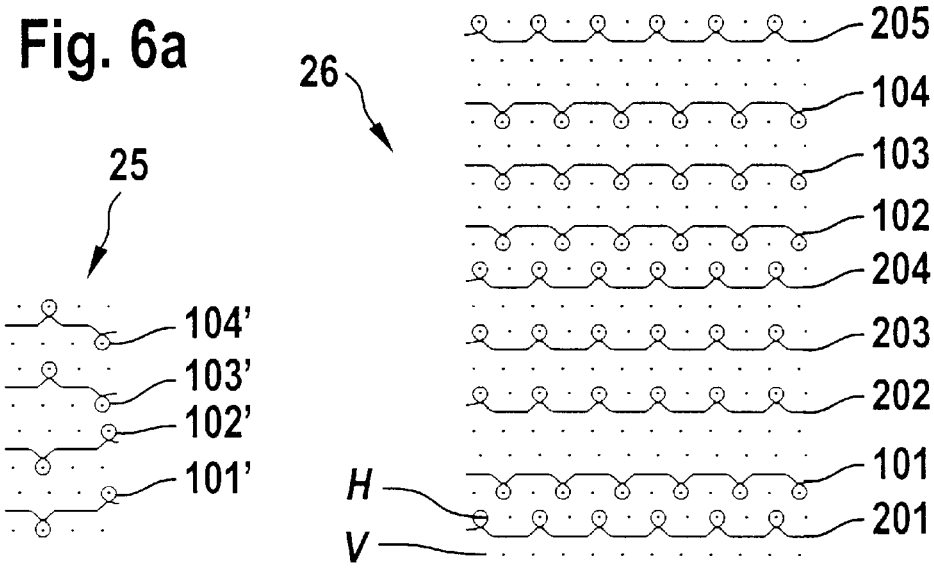
FIGS. 6*a* and 6*b* are views showing a thread running representation of a pattern and a knitting module inserted in the pattern.
Figure 6B:
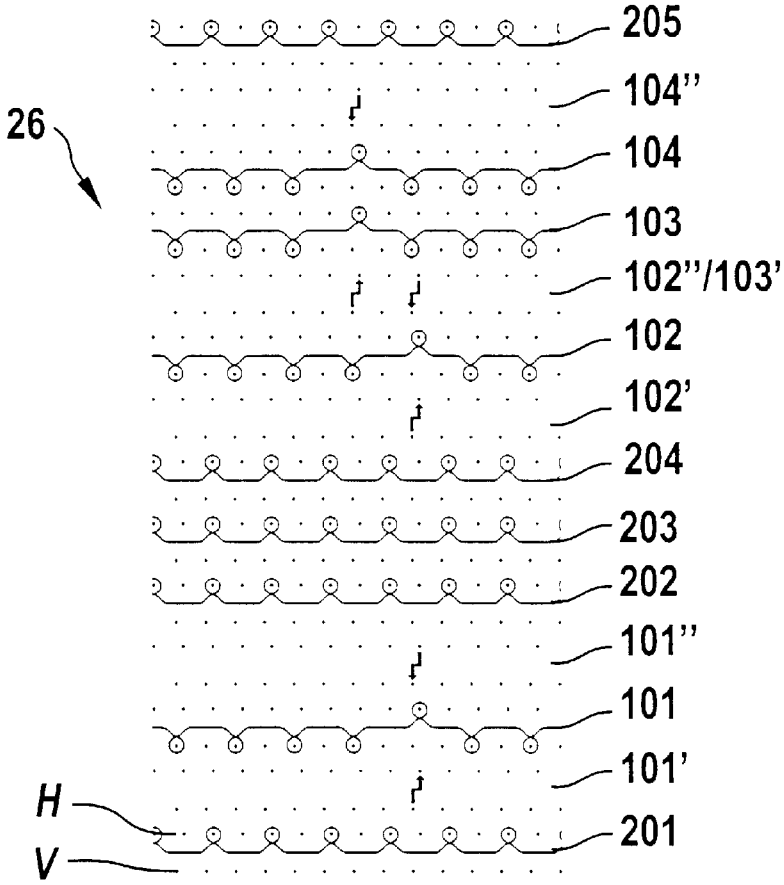

FIGS. 6*a* and 6*b* illustrate the binding of a knitting module 25 in a knitting pattern 26. The knitting pattern 26 in the rows 101–104 contains knitting instructions for the first plane of the knitted product and in the rows 201–205 contains data for the second plane of the knitted article. The module 25 contains knitting informations 101'–104' for a single knitting plane. FIG. 6*b* illustrates how with insertion of the module 25 into the knitting pattern 26 automatically an adaptation of the module 25 in the both different knitting planes 100 and 200 is performed. Since the module 25 contains only data for the first plane of the knitted article, the rows of the second plane 201–205 remain unchanged. For the rows 101–104, the module 25 contains data that in each its row left loops must be formed.

For enabling formation of mainly left loops in the row 101, automatically the row 101' generated, in which the fifth loop from left is transferred to the rear needle bed H. Also automatically a row 101" is produced, in which the left loops are transferred back from the rear needle bed to the front needle bed. In an identical way, for the row 102 a row 102' is generated. Also, the row 102"/102' is automatically produced. Here the left loops are transferred back from the rear needle bed to the front needle bed, and the fourth loop is transferred from left to the rear needle bed, so that it can form a left loop in the rows 103 and 104. In a similarly automatically produced row 104" then the fourth loop is transferred back from left to the front needle bed V.

Figure 7A:
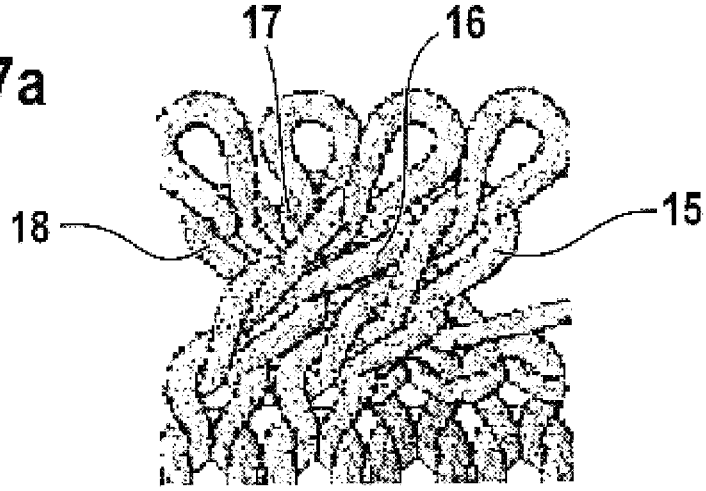
FIGS. 7*a*–7*c* are views showing a loop formation representation of a braid pattern of the front and rear part of a tubular round knitted article.
Figure 7B:
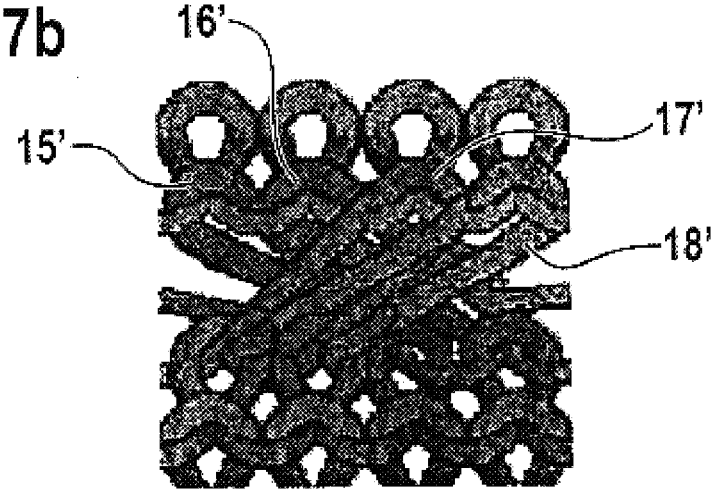
Figure 7C:
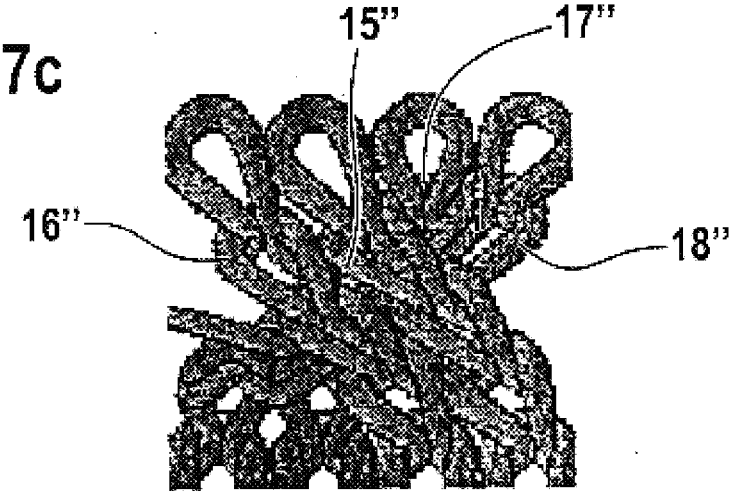

FIG. 7*a* shows a 2×2 braid in the representation for a first knitting plane. The loop train 15, 16 which raises to the right upwardly forms the intersecting visual side, and the loop train 17 raising to the left upwardly is covered. The illustrated knitting plane can be for example the outer front plane. FIG. 7*b* shows the braid of FIG. 7*a* in a representation for the second knitting plane of a tubular round knitted product, as seen from the front side of the knitted product. The second plane can be for example the inner side of the rear part. The braid train 15', 16' is now covered and raises to the left, and the loop train 17', 18' raises to the right and is not visible. In FIG. 7*c* the knitted product is shown from the rear side. FIG. 7*c* shows also the braid which is seen from the outer side of the rear part. The loop trains 15", 16" and 17", 18" are mirror inverted with respect to the orientation in FIG. 7*a*.

Figure 8:
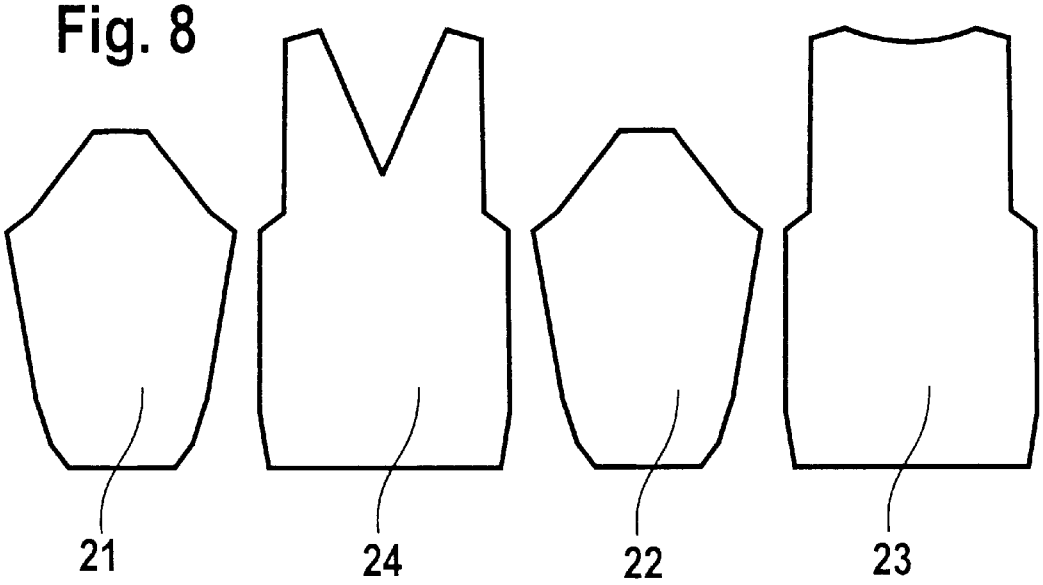
FIG. 8 is a view showing a representation of contours of different knitted parts of a tubular round knitted article.

FIG. 8 shows the contours of a front part 24, a rear part 23, as well as two sleeves 21, 22. The parts 21–24 can be selected completely arbitrarily by a designer.

Figure 9:
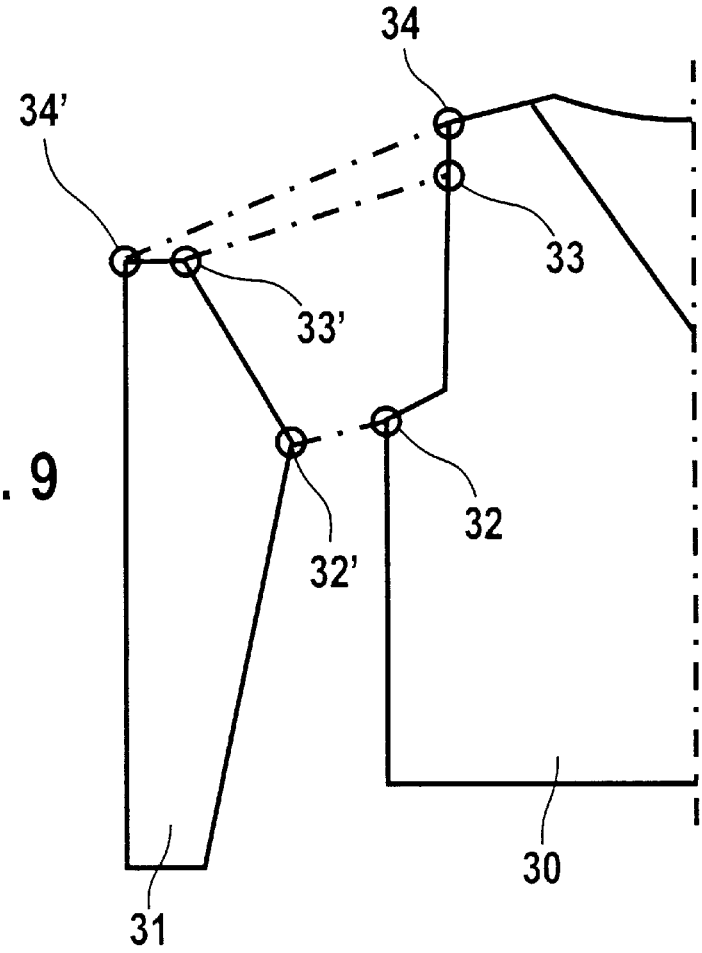
FIG. 9 is a principle view of the definition of connecting points of two knitted parts.

FIG. 9 shows an example for fixing of contour portions on which a body trunk part 30 and a sleeve 31 must be connected with one another. This is performed by fixing the initial and end points 32, 33, 34 on the body trunk part 30 and corresponding initial and end points of the connecting portions 32', 33' and 34' on the sleeve 31. In the region between the points 32/32' and 33/33', the sleeve is suspended on the body trunk part and simultaneously production knitting rows for the sleeve are produced. Between the points 33/33' and 34/34' the sleeves are suspended only on the body trunk part and no loop rows for the sleeve 31 are produced any longer.

Figure 10:
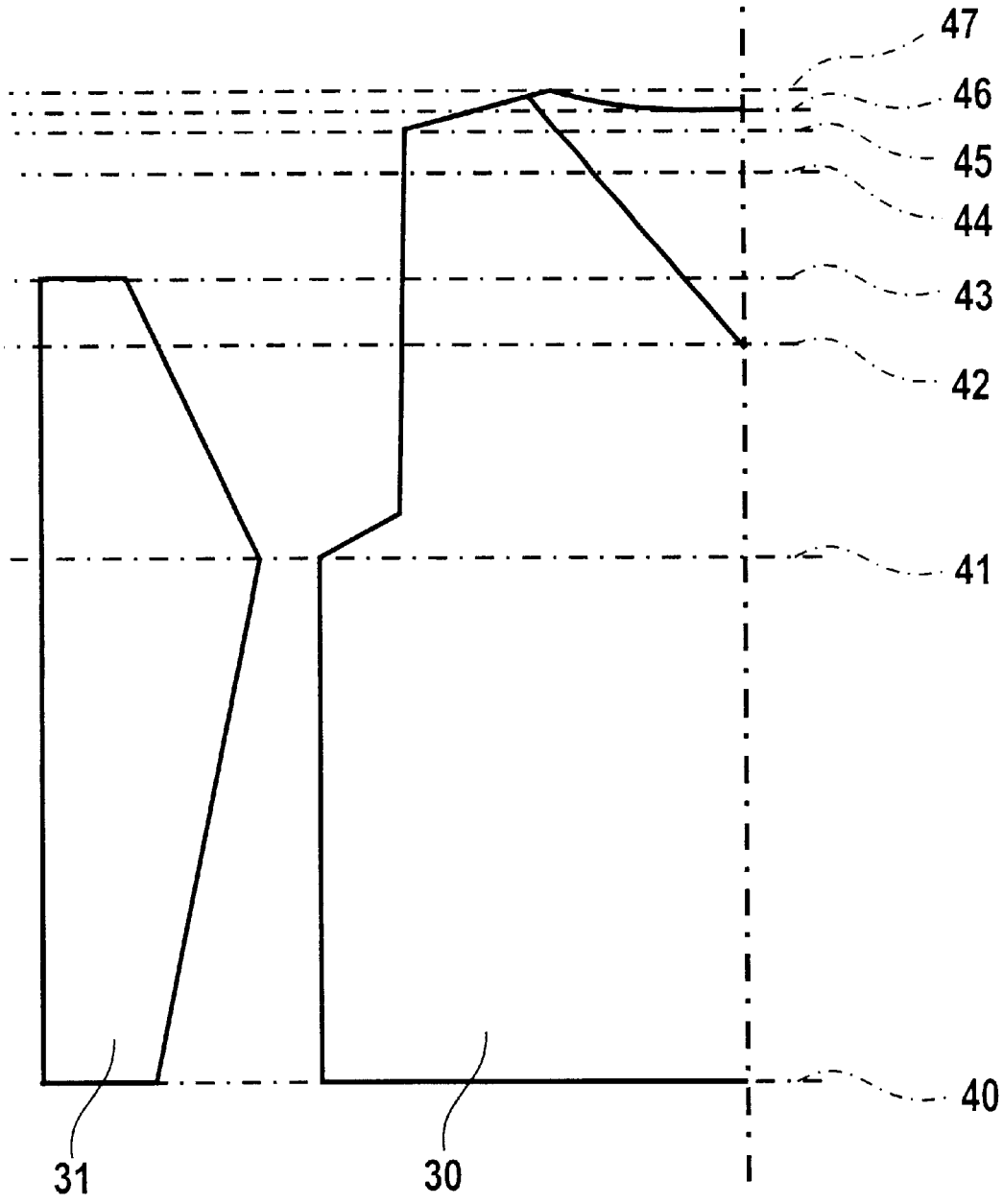
FIG. 10 is a view showing a representation of a knitting row sequence on an example of a sleeve and a body trunk part with a V-section on the front part.

FIG. 10 shows example as an on the front part 30 and the sleeve 31 of FIG. 9, the sequence of criteria, in accordance with which a knitting row sequence is provided. 40 identifies the starting knitting row both of the body trunk part 30 and the sleeve 31. At the knitting row 41, the separate production of the body trunk part 30 and the sleeve 31 starts, and simultaneously the binding of the sleeve 31 to the body trunk part 30 starts. Both parts as well as the other not shown sleeves are further knitted from this position as a single tubular round knitted product. At the position 42 an interruption of the tubular knitted product is performed at the front part for the production of a V portion. On the position 43 the sleeve 31 comes to end in correspondence with a contour description. The position 44 identifies the last production knitting row of the sleeve 31 in correspondence with the knitting process. The row 45 is the last body trunk row, in which the sleeve 31 is bound to the body trunk part 30. In the knitting row 46 an interruption of the tubular knitted product on the rear side of the body trunk part 30 is performed for producing a neck back section. Reference numeral 47 identifies the last produced knitting row.

Figure 11:
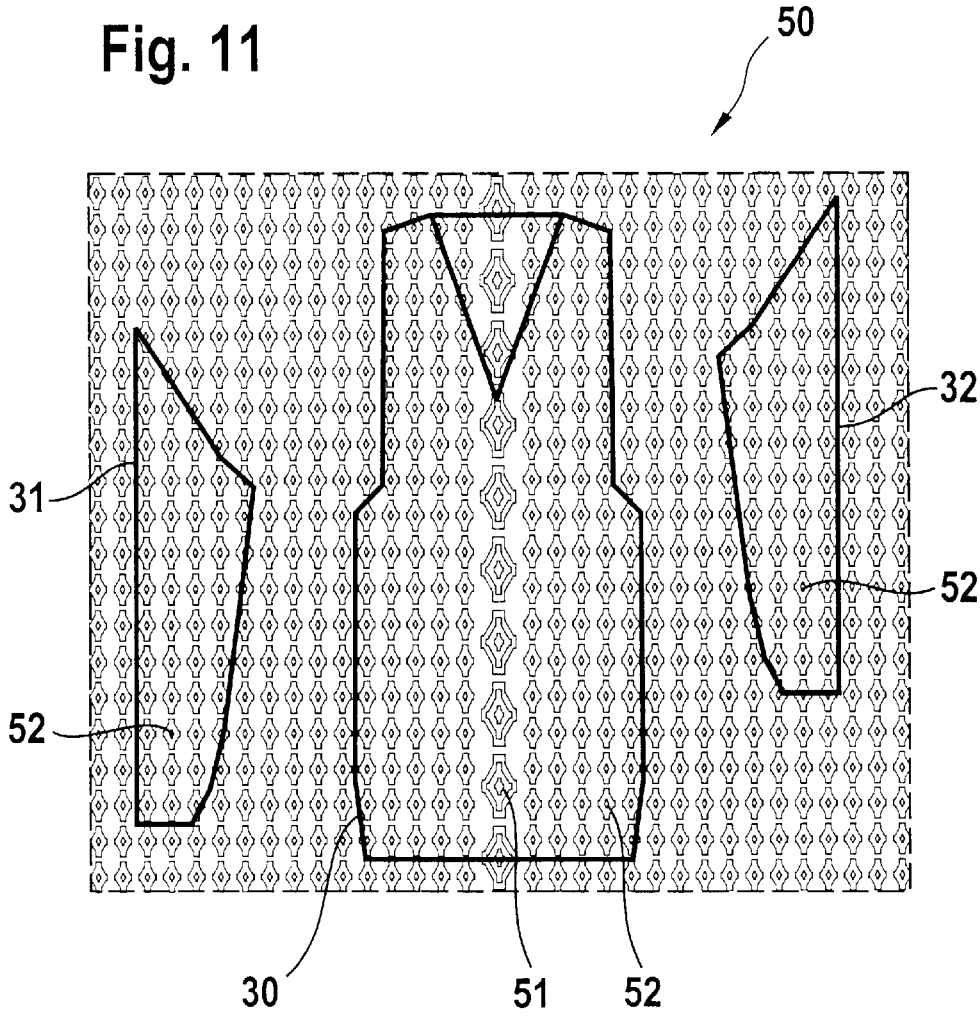
FIG. 11 is a principle view showing the introduction of a pattern of a knitting pattern in different knitted parts.

In accordance with the sequence of knitting rows shown in FIG. 10, in the inventive method the introduction of the knitting pattern is performed, which were before generated for the knitting parts, in the contours of the sleeves 31, 32 as well as the body trunk part 30. The contours 30–32 are displaced on the pattern field 50 so long until the individual pattern elements 51 and 52 are arranged on the right position in the corresponding knitting part 30–32 as shown in FIG. 11.

Figure 12A:
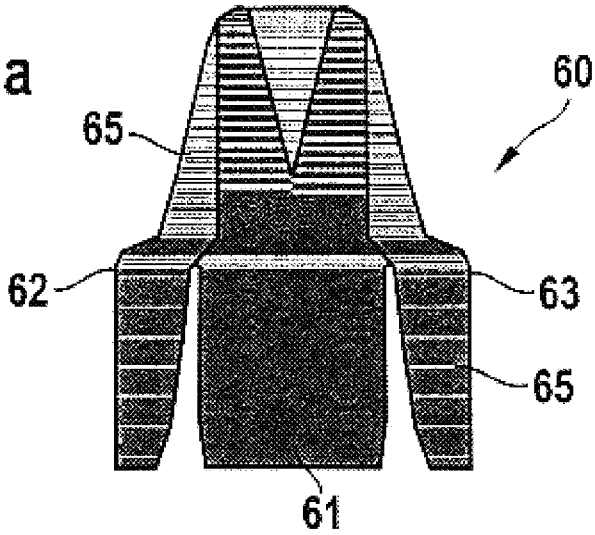
FIGS. 12*a*–12*c* are views showing different representations of a total knitted article composed of individual knitted parts.
Figure 12B:
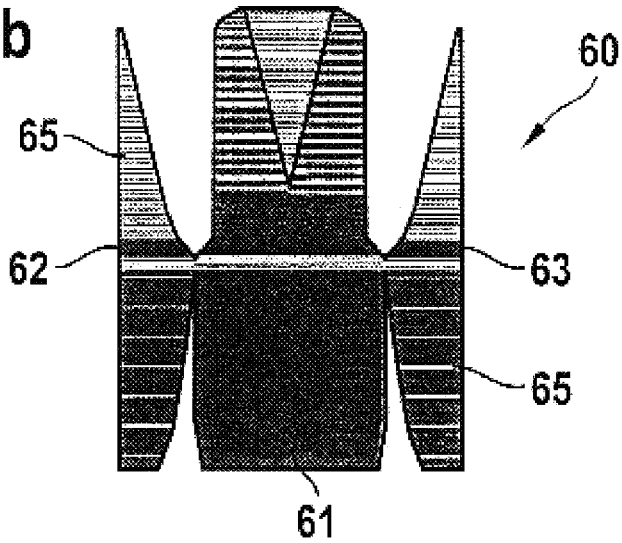
Figure 12C:
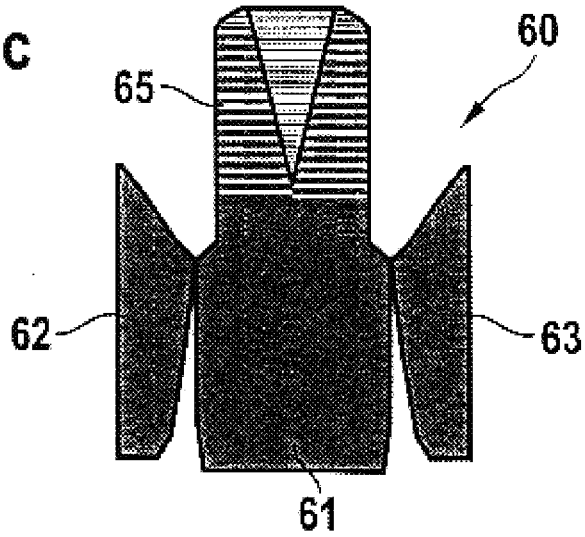

Subsequently the total knitted piece can be indicated in different representation types as shown in FIG. 12. FIG. 12*a* shows the standard representation of a total knitted piece 60, wherein the knitting rows for the sleeves 62 and 63 are identified starting from the sleeve connection with the body trunk part 31, 61. When on a knitted part no loops are formed, while on the other knitted parts loops are formed, then in the corresponding knitted part a knitted row is identified with a definite color 65 which forms the background of the knitted article. In the shown example the non-formation of loops is identified with a white color. FIG. 12*b* shows a variant of the illustration of FIG. 12*a*, wherein the knitting rows for the sleeves 62 and 63 are released from the body trunk and indicated in a vertical direction parallel to the body trunk part 61. FIG. 12*c* corresponds to FIG. 12*b* wherein however with the sleeves 62 and 63 the illustration of individual knitting rows in which no loops are formed for the sleeves 62 and 63 is dispensed with. It is to be understood that from the total knitted piece also a reality-close loop formation representation can be indicated, to test the design results based on purely optical criteria.

It will be understood that each of the elements described above, or two or more together, may also find a useful application in other types of methods and constructions differing from the types described above.

While the invention has been illustrated and described as embodied in method of and device for designing of tubular round knitted articles produced on a flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of designing tubular round knitted articles with at least one front part and at least one rear part produced on a flat knitting machine, the method comprising the steps of providing a knitting pattern for each front part and each rear part as well as in some cases further knitted parts by an inputting and indicating device and storing pattern data; describing a contour of each knitted part by the inputting and indicating device and storing contour data; fixing a contour portion of the knitted part on which a connection with another knitted part must be produced, and storing data of this contour portion; assembling contours of the knitted parts to a total knitted piece and determining a sequence of knitting rows with which a total knitted piece is producible; for each knitted part indicating the knitting pattern and the contour on the indicating device, by the inputting device displacing in the contour on the knitting pattern until the knitting pattern fills the contour in a desired manner; indicating the total knitted piece with the selected and stored knitting pattern-and contour data for the individual knitted parts; and determining knitting informations for each knitting row for producing the total knitted piece in accordance with the pattern and contour data of the knitted parts.

2. A method as defined in claim 1; and further comprising the steps of converting a knitting information for each knitting row into knitting data for a flat knitting machine; and controlling one or several flat knitting machines for producing a round knitted article.

3. A method as defined in claim 1; and further comprising correcting an element selected from the group consisting of the pattern, the contour of the total knitted piece, and the contour of individual knitted parts, with performing changes automatically in the stored pattern-and contour data of the corresponding one of the knitted parts.

4. A method as defined in claim 1; and further comprising designing the knitting pattern in a representation selected from the group consisting of a loop forming representation and a thread running representation; calculating from data of one representation type data for another representation type so that the knitting pattern in each designing stage of the knitted article is indicatible in both representation types.

5. A method as defined in claim 4; and further comprising for the loop forming representation, forming a reality-close approximately three-dimensional representation of all elements of the knitted piece selected from the group consisting of loops, tucks and floats.

6. A method as defined in claim 1; and further comprising associating of the individual knitted parts with one or several planes of the total knitted piece.

7. A method as defined in claim 1; and further comprising associating each knitted element selected from the group consisting of loops, tucks and floats of one knitted part to one of knitting planes.

8. A method as defined in claim 1; and further comprising storing sections of the knitting pattern as individual modules; and using the modules at a different location of the pattern or during production of the knitting pattern of another knitted part.

9. A method as defined in claim 8; and further comprising introducing the module into a surrounding knitted pattern during the use at another location in a loop-technically correct manner; and if required performing an adaptation of a knitting plane association of the individual knitting elements of the module.

10. A method as defined in claim 1; and further comprising, during determining a contour portion of the knitted part on which a connection with another knitted part must be produced, determining an initial and an end point, a portion and a type of connection; and storing the thusly determined points, portion and type of connection.

11. A method as defined in claim 10; and further comprising performing the determining step with a longitudinal compensation between the knitted parts.

12. A method as defined in claim 10; and further comprising performing the determining step without a longitudinal compensation between the knitted parts.

13. An arrangement for designing tubular round knitted articles with at least one front part and at least one rear part produced on a flat knitting machine, the arrangement comprising at least one storage device for designing data; at least one indicating device for representing designing images of a knitted article; at least one inputting device for producing and changing the designing image; a device for assembling a contours of at least one front part and at least one rear part in accordance with manually introducible connection instructions and for computing knitting rows required for producing the contour of a total knitted piece, as well as for computing knitting information for each knitting row of the total knitted piece in accordance with pattern and contour data of individual knitted parts.

14. An arrangement as defined in claim 13; and further comprising a device for converting the emitting information of each knitting row into knitting data for a flat knitting machine.

15. An arrangement as defined in claim 13, wherein said indicating device is operative for simultaneously representing a loop image and thread running representations of the knitted article or the knitted parts.

16. An arrangement as defined in claim 15, wherein said indicating arrangement is formed so that by changing one of the representations simultaneously the other representation is also changed.

17. An arrangement as defined in claim 13; and further comprising a device for combining several knitting elements of a thread running-or loop forming representation two modules; and storage devices for storing the modules.

18. An arrangement as defined in claim 13; and further comprising a device for loop-technically correct insertion of modules into an available knitting pattern; a device for reducing and increasing the modules; a device for multiplying the modules, and a device for mirror-inverting of modules.

* * * * *